US007904013B2

(12) United States Patent
Hiroi et al.

(10) Patent No.: US 7,904,013 B2
(45) Date of Patent: Mar. 8, 2011

(54) IMAGE-FORMING APPARATUS

(75) Inventors: Toshiaki Hiroi, Toyokawa (JP); Yasuyuki Inada, Toyokawa (JP); Tomohide Mori, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/155,630

(22) Filed: Jun. 6, 2008

(65) Prior Publication Data

US 2008/0310877 A1 Dec. 18, 2008

(30) Foreign Application Priority Data

Jun. 18, 2007 (JP) ..... 2007-159710

(51) Int. Cl.
*G03G 21/00* (2006.01)

(52) U.S. Cl. ..... 399/350; 399/101; 399/345; 399/351

(58) Field of Classification Search ..... 399/345, 399/350, 351, 101
See application file for complete search history.

(56) References Cited

U.S. PATENT DOCUMENTS

| | | | | |
|---|---|---|---|---|
| 5,778,281 | A | 7/1998 | Handa | |
| 6,456,820 | B1 * | 9/2002 | Sato et al. | 399/350 |
| 6,522,856 | B2 * | 2/2003 | Nakayama | 399/297 |
| 7,065,316 | B2 | 6/2006 | Yanagida et al. | |
| 2003/0086738 | A1 | 5/2003 | Sakanobe et al. | |
| 2006/0088342 | A1 * | 4/2006 | Hamada et al. | 399/296 |
| 2006/0257176 | A1 * | 11/2006 | Kawasaki et al. | 399/299 |
| 2007/0122211 | A1 * | 5/2007 | Maekawa | 399/302 |
| 2009/0041514 | A1 | 2/2009 | Maehara | |

FOREIGN PATENT DOCUMENTS

| | | | |
|---|---|---|---|
| JP | 09-197845 | | 7/1997 |
| JP | 2003-167492 | A | 6/2003 |
| JP | 2003-202786 | | 7/2003 |
| JP | 2004-151206 | A | 5/2004 |
| JP | 2007-017666 | * | 1/2007 |
| WO | WO 2007/046218 | | 4/2007 |

OTHER PUBLICATIONS

Notification of Reason for Refusal in JP 2007-159710 dated May 26, 2009, and an English Translation thereof.

* cited by examiner

*Primary Examiner* — David M Gray
*Assistant Examiner* — Barnabas T Fekete
(74) *Attorney, Agent, or Firm* — Buchanan Ingersoll & Rooney PC

(57) ABSTRACT

An image-forming apparatus that is provided with an intermediate transfer member that has a hard releasing layer formed on the surface thereof, supports a toner image primary-transferred onto the hard releasing layer from a latent-image supporting member, and secondary-transfers the supported toner image onto an image-receiving medium, and a cleaning blade that is arranged in contact with the intermediate transfer member, and removes residual toner from the hard releasing layer of the intermediate transfer member, wherein the cleaning blade has an impact resilience in the range from 20 to 50% at 20° C.

7 Claims, 4 Drawing Sheets

IMAGE-FORMING APPARATUS

This application is based on application(s) No. 2007-159710 filed in Japan, the contents of which are hereby incorporated by reference.

BACKGROUND OF THE INVENTION

1. Field of the Invention

The present invention relates to an image-forming apparatus, such as a mono-chrome/full-color copying machine, a printer, a facsimile and a composite machine thereof.

2. Description of the Related Art

In an image-forming apparatus of an intermediate transfer system in which toner images of respective colors, formed on latent-image supporting members, are respectively primary-transferred, and superposed on an intermediate transfer member, and then secondary-transferred onto a image-receiving medium at one time. Such an image-forming apparatus causes a slight amount of residual toner on the intermediate transfer member upon secondary-transferring. For this reason, a method in which an elastic blade made of rubber or the like is made in contact therewith as a cleaning means for removing the residual toner has been widely used.

In order to improve the secondary transferring rate, a method is proposed in which a hard releasing layer is formed on the surface of the intermediate transfer member so that the releasing property to toner is improved. In such an image-forming apparatus, however, although the secondary-transferring efficiency is improved, insufficient cleaning occurs to cause residual toner on the intermediate transfer member, even when a cleaning blade is used. More specifically, since the hard releasing layer on the surface of the intermediate transfer member is formed so as to make toner more easily separated, a frictional force exerted onto the blade becomes lower in comparison with the surface of a conventional intermediate transfer member without a hard releasing layer. For this reason, the edge portion of the cleaning blade is not drawn in the moving direction of the intermediate transfer member, but is allowed to slide on the surface, with the result that insufficient cleaning, such as escaped toner, tends to occur. In particular, in a low temperature environment, the occurrence of insufficient cleaning becomes conspicuous. In the case when toner having a spherical shape with a small particle size is used so as to form a high-quality image, that is, for example, in the case when a polymerized toner is used in combination, the occurrence of insufficient cleaning becomes conspicuous. When the contact pressure of the cleaning blade against the intermediate transfer member is increased so as to ensure the frictional force against the intermediate transfer member, edge damage (chipping) in which the edge portion of the cleaning blade is damaged tends to occur.

From the viewpoint of an improved cleaning characteristic of a photosensitive member and a conventional intermediate transfer member, the application of a cleaning blade having an impact resilience coefficient of 20% or more at 10° C. and in the range from 70% or less at 40° C., a 300% modulus of 200 kg/cm$^2$ or more, and a tear strength of 70 kg/cm or more has been proposed (Japanese Patent-Application Laid-Open No. 2003-167492), and the application of a cleaning blade having an impact resilience coefficient of 35% or more at 10° C., with a rate of change in the impact resilience within a temperature range from 10 to 40° C. being set to 1.4/deg or less has also been proposed (Japanese Patent-Application Laid-Open No. 2004-151206).

BRIEF SUMMARY OF THE INVENTION

The object of the present invention is to provide an image-forming apparatus which, even when an intermediate transfer member having a hard releasing layer on the surface thereof is used, can prevent insufficient cleaning on the intermediate transfer member in a low temperature environment.

The object above can be achieved by an image-forming apparatus comprising:

an intermediate transfer member that has a hard releasing layer formed on a surface thereof, supports a toner image primary-transferred on the hard releasing layer from a latent-image supporting member, and secondary-transfers the supported toner image onto an image-receiving medium, and a cleaning blade that is arranged in contact with the intermediate transfer member, and removes residual toner from the hard releasing layer of the intermediate transfer member, wherein the cleaning blade has an impact resilience in the range from 20 to 50% at 20° C.

DETAILED DESCRIPTION OF THE INVENTION

The present invention relates to an image-forming apparatus that is provided with an intermediate transfer member that has a hard releasing layer formed on the surface thereof, supports a toner image primary-transferred onto the hard releasing layer from a latent-image supporting member, and secondary-transfers the supported toner image onto a image-receiving medium, and a cleaning blade that is arranged in contact with the intermediate transfer member, and removes residual toner from the hard releasing layer of the intermediate transfer member, wherein the cleaning blade has an impact resilience in the range from 20 to 50% at 20° C.

In accordance with the image-forming apparatus of the present invention, even when an intermediate transfer member having a hard releasing layer formed on the surface thereof is used, it is possible to prevent insufficient cleaning on the intermediate transfer member in a low temperature environment. The insufficient cleaning can be effectively prevented for a long time without an edge damage on the cleaning blade.

BEST MODE FOR CARRYING OUT THE INVENTION

An image-forming apparatus in accordance with the present invention is provided with an intermediate transfer member that supports a toner image primary-transferred from a latent-image supporting member, and secondary-transfers the supported toner image onto a image-receiving medium, and a cleaning blade that is arranged in contact with the intermediate transfer member and used for removing residual toner on the intermediate transfer member. The following description will discuss the image-forming apparatus of the present invention by exemplifying a tandem-type full-color image-forming apparatus having latent-image supporting members for respective developing units of respective colors, each of which forms a toner image on the latent-image supporting member; however, any apparatus having another structure may be used as long as it has an intermediate transfer member and a cleaning blade, and, for example, a four-cycle full-color image-forming apparatus, which has developing units of respective colors for a single latent-image supporting member, may be used.

Figure 1:
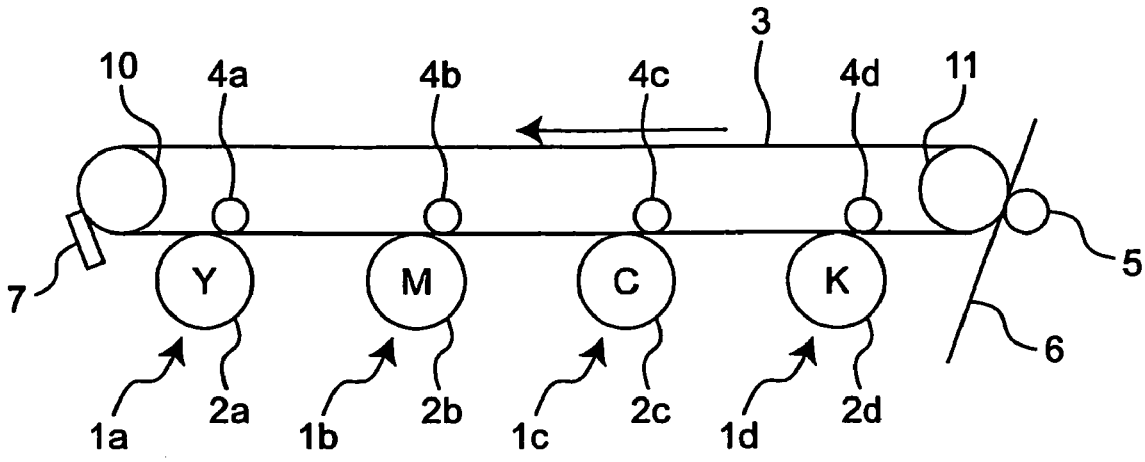
FIG. 1 is a schematic structural drawing that shows one example of an image-forming apparatus in accordance with the present invention.

FIG. 1 is a schematic diagram that shows one example of an image-forming apparatus of the present invention. In a tandem-type full-color image-forming apparatus of FIG. 1, each of developing units (1*a*, 1*b*, 1*c* and 1*d*) is normally provided with at least a charging device, an exposing device, a developing device, a cleaning device and the like (none of which are shown) that are placed around each of latent-image supporting members (2*a*, 2*b*, 2*c* and 2*d*). These developing units (1*a*, 1*b*, 1*c* and 1*d*) are placed in parallel with an intermediate transfer member 3 that is extended by extension rollers (10, 11). Toner images, formed on the surfaces of the latent-image supporting members (2*a*, 2*b*, 2*c* and 2*d*) in the respective developing units, are respectively primary-transferred onto the intermediate transfer member 3 by using primary-transfer rollers (4*a*, 4*b*, 4*c* and 4*d*), and superposed on the intermediate transfer member, so that a full-color image is formed. The full-color image, transferred onto the surface of the intermediate transfer member 3, is secondary-transferred onto an image receiving medium 6 such as paper at one time by using a secondary-transfer roller 5, and then allowed to pass through a fixing device (not shown), so that a full-color image is formed on the image receiving medium. Residual toner after the transferring process, left on the intermediate transfer member, is removed by a belt cleaning device 7.

The latent-image supporting members (2*a*, 2*b*, 2*c* and 2*d*) are so-called photosensitive members on which toner images are formed based upon electrostatic latent images formed on the surfaces thereof. With respect to the latent-image supporting member, not particularly limited as long as it can be installed in a conventional image-forming apparatus, the one having an organic-based photosensitive layer is normally used.

In the present invention, the intermediate transfer member 3 has a hard releasing layer on its surface. In FIG. 1, the intermediate transfer belt is shown as the intermediate transfer member 3; however, not limited to this as long as it has a hard releasing layer on its surface, and, for example, a so-called intermediate transfer drum may be used.

Figure 2:
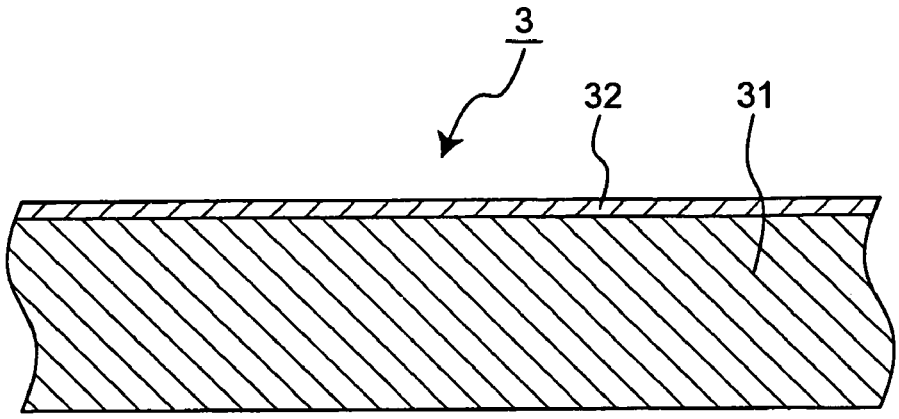
FIG. 2 is a schematic cross-sectional view that shows a layer structure of an intermediate transfer belt.

By exemplifying the intermediate transfer member 3 having a seamless belt shape, the following description will discuss the intermediate transfer member of the present invention. FIG. 2 is a schematic cross-sectional view that shows a layer structure of the intermediate transfer belt 3.

The intermediate transfer belt 3 has at least a base member 31 and a hard releasing layer 32 formed on the surface of the base member 31.

Although not particularly limited, the base member 31 preferably has a surface resistivity in the range from $10^6\Omega/\square$ to $10^{12}\Omega/\square$ and is normally formed into a seamless belt shape. The base member 31 is made from a material formed by dispersing a conductive filler such as carbon in the following material or by adding an ionic conductive material to the following materials: resin materials, such as polycarbonate (PC); polyimide (PI); polyphenylene sulfide (PPS); polyamideimide (PAI); fluorine-based resins such as polyvinylidene fluoride (PVDF) and a tetrafluoroethylene-ethylene copolymer (ETFE); urethane-based resins such as polyurethane; polyamide-based resins such as polyamideimide, or rubber materials such as ethylene-propylene-diene rubber (EPDM); nitrile-butadiene rubber (NBR); chloroprene rubber (CR); silicone rubber; and urethane rubber. In the case of a resin material, the thickness of the base member is normally set to 50 to 200 μm, and in the case of a rubber material, it is set to 300 to 700 μm.

The intermediate transfer belt 3 may have another layer between the base member 31 and the hard releasing layer 32, and the hard releasing layer 32 is placed as an outermost surface layer.

Prior to the lamination of the hard releasing layer 32, the surface of the base member 31 may be pre-treated by a known surface treating method, such as plasma, flame and UV ray irradiation.

The hard releasing layer 32 is so hard that it exerts a releasing property to the toner. With respect to the hard releasing layer, examples thereof include: an inorganic oxide layer and a hard carbon-containing layer.

The hardness of the hard releasing layer 32 is normally set to 2 GPa or more, in particular, in the range from 2 to 11 GPa. From the viewpoints of preventing cracks and peeling in the layer, the thickness of the hard releasing layer is preferably set to 5 μm or less, more preferably in the range from 10 nm or more to 5 μm or less.

In the present specification, the hardness of the hard releasing layer is measured by a nano-indentation method, and given as a value obtained by using a NANO Indenter XP/DCM (made by MTS Systems Co., Ltd./MTS NANO Instruments Co., Ltd.).

The inorganic oxide layer preferably contains at least one oxide selected from $SiO_2$, $Al_2O_3$, $ZrO_2$ and $TiO_2$, and in particular, $SiO_2$ is preferably contained. The inorganic oxide layer is preferably manufactured by using a plasma CVD method in which a mixed gas containing at least a discharge gas and a material gas for the inorganic oxide layer is formed into a plasma, so that a film is deposited and formed in accordance with the material gas, in particular, by using the plasma CVD method carried out under atmospheric pressure or under near atmospheric pressure. The thickness of the inorganic oxide layer is set to 10 to 1000 nm, preferably to 100 to 500 nm.

By exemplifying a process in which an inorganic oxide layer using silicon oxide ($SiO_2$) is formed through an atmospheric pressure plasma CVD method, the following description will discuss the manufacturing apparatus and the manufacturing method thereof. The atmospheric pressure or pressure near the atmospheric pressure refers to a pressure in the range from 20 kPa to 110 kPa, and the pressure is preferably set in the range from 93 kPa to 104 kPa in order to obtain desirable effects described in the present invention.

Figure 3:
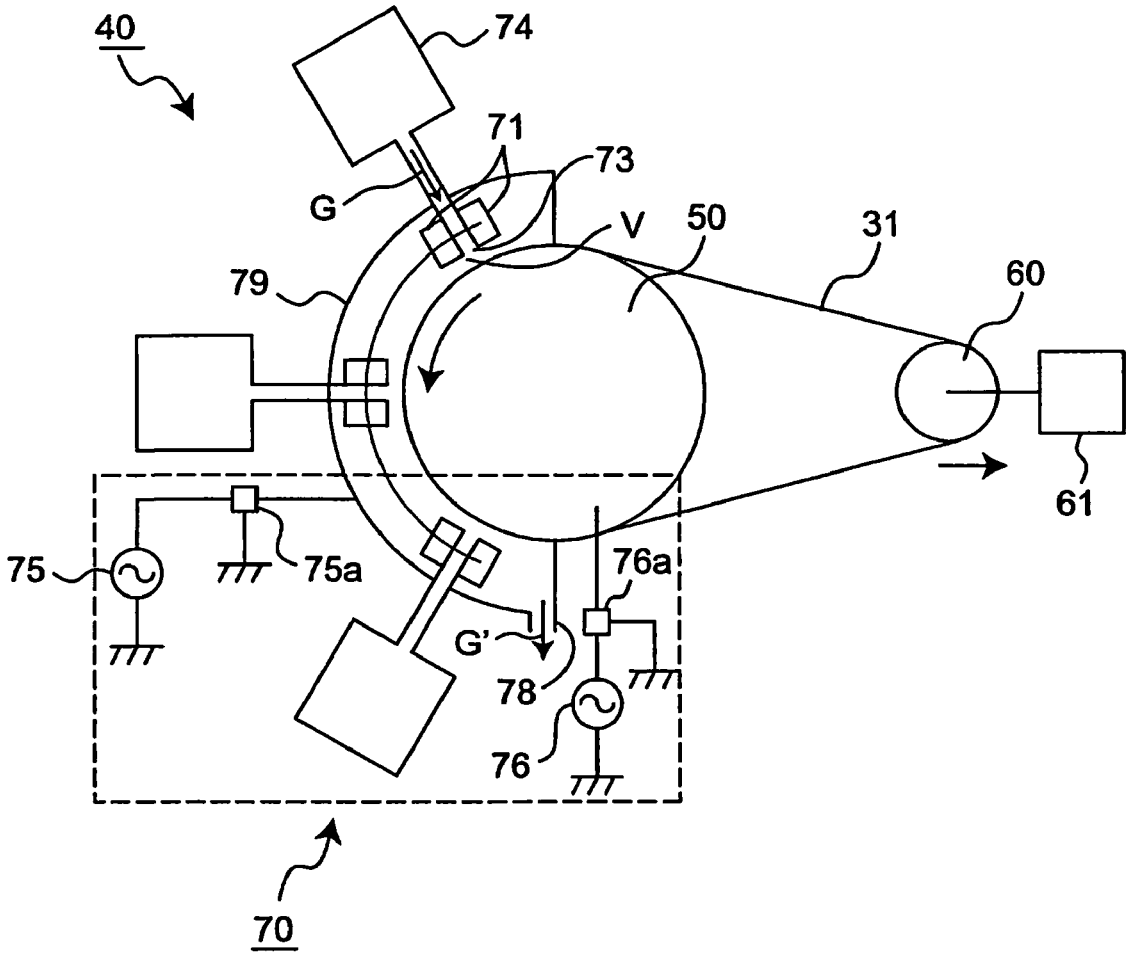
FIG. 3 is an explanatory drawing that shows a manufacturing apparatus that forms an intermediate transfer member.

FIG. 3 is an explanatory drawing that shows a manufacturing apparatus used for forming the inorganic oxide layer. The manufacturing apparatus 40 of the inorganic oxide layer has a structure in which the discharging space and the thin-film depositing area are prepared as virtually the same portion, and by using a direct system in which the base member is exposed to plasma so as to carry out depositing and forming processes, the inorganic oxide layer is formed on the base member, and the manufacturing apparatus 40 is configured by a roll electrode 50 that rotates in an arrow direction with the base member 31 shaped into an endless belt being passed thereon, a driven roller 60 and an atmospheric pressure plasma CVD device 70 that is a film-forming device used for forming the inorganic oxide layer on the surface of the base member.

The atmospheric pressure plasma CVD device 70 is provided with at least one set of a fixed electrode 71, a discharging space 73 that forms an opposing area between the fixed electrode 71 and the roll electrode 50 and allows a discharging to be exerted therein, a mixed gas supplying device 74 that generates a mixed gas G of at least material gas and a discharge gas, and supplies the mixed gas G to the discharging space 73, a discharging container 79 that reduces an air flow entering the discharging space 73 or the like, a first power supply 75 connected to the fixed electrode 71, a second power supply 76 connected to the roll electrode 50 and an exhausting unit 78 used for exhausting the used exhaust gas G', which are placed along the periphery of the roll electrode 50. The second power supply 76 may be connected to the fixed electrode 71, and the first power supply 75 may be connected to the roll electrode 50.

The mixed gas supplying device 74 supplies a mixed gas containing a material gas used for forming a film containing silicon oxide, and a rare gas such as a nitrogen gas or an argon gas, to the discharging space 73.

The driven roller 60 is pressed in an arrow direction by a tension applying means 61, so that a predetermined tension is imposed on the base member 31.

The tension applying means 61 releases the application of the tension, for example when the base member 31 is exchanged, so that, for example, the exchanging process of the base member 31 can be carried out easily.

The first power supply 75 outputs a voltage having a frequency ω1, and the second power supply 76 outputs a voltage having a frequency ω2 higher than the frequency ω1, so that an electric field V in which the frequencies ω1 and ω2 are multiplexed is generated in a discharging space 73 by these voltages. Thus, a mixed gas G is formed into plasma by the electric field V, so that a film (inorganic oxide layer) is deposited on the surface of the base member 31 in accordance with a material gas contained in the mixed gas G.

In another embodiment, of the roll electrode 50 and the fixed electrode 71, one of the electrodes may be connected to earth, with the other electrode being connected to a power supply. In this case, the second power supply is preferably used as a power supply, since a precise film-forming process is available, and this manner is preferably used, in particular, in the case when a rare gas such as argon gas is used as a discharge gas.

Among a plurality of fixed electrodes, those fixed electrodes positioned on the downstream side in the rotation direction of the roll electrode and a mixed gas supplying device may be used to deposit the inorganic oxide layers in a manner so as to be stacked, so that the thickness of the inorganic oxide layers may be adjusted.

Among a plurality of fixed electrodes, the fixed electrode positioned on the farthest downstream side in the rotation direction of the roll electrode and the mixed gas supplying device may be used to deposit the inorganic oxide layers, and the other fixed electrodes positioned on the upper stream side and the mixed gas supplying device may be used to deposit another layer, such as an adhesive layer used for improving the adhesive property between the inorganic oxide layer and the base member.

In order to improve the adhesive property between the inorganic oxide layer and the base member, a gas supplying device for supplying a gas such as an argon, oxygen or hydrogen gas and a fixed electrode are placed on the upstream of the fixed electrode and the mixed gas supplying device used for forming the inorganic oxide layer so as to carry out a plasma process, so that the surface of the base member may be activated.

Specific examples of the hard carbon-containing layer include an amorphous carbon film, a hydrogenated amorphous carbon film, a tetrahedron amorphous carbon film, a nitrogen-containing amorphous carbon film and a metal containing amorphous carbon film. The thickness of the hard carbon-containing layer is preferably set to the same thickness as that of the inorganic oxide layer.

The hard carbon-containing layer may be manufactured by using the same method as the above-mentioned manufacturing method of the inorganic oxide layer; that is, it is manufactured by using a plasma CVD method in which at least a mixed gas of a discharge gas and a material gas is formed into plasma so that a film is deposited and formed in accordance with the material gas, in particular, by using the plasma CVD method carried out under atmospheric pressure or under near atmospheric pressure.

With respect to the material gas to be used for forming the hard carbon-containing layer, an organic compound gas, which is in a gaseous state or in a liquid state under normal temperature, in particular, a hydrogen carbide gas, is preferably used. The phase state of each of these materials is not necessarily a gaseous phase under normal temperature and normal pressure, and those having either a liquid phase or a solid phase may be used as long as they can be evaporated through fusion, evaporation or sublimation, by a heating process, a pressure-reducing process or the like carried out in the mixed gas supplying device. With respect to the hydrogen carbide gas serving as a material gas, a gas containing at least hydrogen carbide, such as paraffin-based hydrocarbons, like $CH_4$, $C_2H_6$, $C_3H_8$ and $C_4H_{10}$, acetylene-based hydrocarbon like $C_2H_2$ and $C_2H_4$, olefin-based hydrocarbon, diolefin-based hydrocarbon, and aromatic hydrocarbon, may be used. Other than hydrocarbons, for example, any compound may be used as long as it contains at least carbon elements, such as alcohols, ketones, ethers, esters, CO and $CO_2$.

The cleaning blade 7 to be used in the present invention has an impact resilience in the range from 20 to 50%, preferably from 25 to 40% at 20° C. The cleaning blade is drawn in the moving direction of the intermediate transfer member by a frictional force in association with the intermediate transfer member, so that the residual toner is removed. In the case when the cleaning blade having a sufficiently high value in impact resilience as described above is used, since the cleaning blade, deformed upon contacting, is allowed to return quickly, even when used under a low temperature environment, it is possible to restrain a reduction in the contact pressure in comparison with the conventional cleaning blade, and consequently to continuously maintain a sufficient frictional force. When combined with an intermediate transfer member having a high releasing property in its surface layer, the cleaning blade is allowed to ensure a frictional force required for removing the residual toner, within an appropriate range. As a result, it becomes possible to make the cleaning blade free from an edge damage (chipping) that is damage caused therein at a contact portion (edge portion) with the intermediate transfer member, and consequently to effectively remove the residual toner on the hard releasing layer of the intermediate transfer member for a long time. In the case when the impact resilience is too small, since the frictional force between the cleaning blade and the intermediate transfer member becomes extremely low, the edge of the cleaning blade tends to easily slide on the surface of the intermediate transfer member, and is hardly drawn in the moving direction. Consequently, the residual toner tends to escape in a low-temperature environment, resulting in insufficient cleaning. When the contact pressure of the cleaning blade onto the intermediate transfer member is raised so as to ensure the frictional force to the intermediate transfer member, an edge damage tends to occur. In contrast, in the case when the impact resilience is too high, since the frictional force between the cleaning blade and the intermediate transfer member becomes extremely high, the edge of the cleaning blade hardly slides on the surface of the intermediate transfer member, and is easily drawn in the moving direction. For this reason, although insufficient cleaning hardly occurs in a low temperature-low humidity environment, an edge damage easily occurs in particular, in a high-temperature/high-humidity environment.

The impact resilience refers to a resilience upon receipt of an impact, and is indicated by a value measured by a method in compliance with JIS-K6255 at 20° C.

The impact resilience is appropriately determined by selecting a constituent material for a cleaning blade.

From the viewpoint of cleaning characteristics, the cleaning blade 7 is preferably set to 70 degrees or more in JIS A hardness, in particular in the range from 70 to 80 degrees, and the Young's modulus thereof is preferably set in the range from 5 to 10 MPa, in particular from 6.5 to 10 MPa.

The JIS A hardness of the cleaning blade is indicated by a value measured in compliance with JIS A6253.

The Young's modulus is indicated by a value measured in compliance with JIS-K6254.

With respect to the dynamic torque upon driving the intermediate transfer member 3, the cleaning blade 7 is arranged in contact with the intermediate transfer member 3 in such a manner that a dynamic torque Ta at the time when the cleaning blade is arranged in contact with the intermediate transfer member and a dynamic torque Tb at the time when the cleaning blade is placed apart from the intermediate transfer member are allowed to satisfy the following relationship:

$$Ta-Tb \geqq 0.07(N\cdot m);$$

in particular, $0.2 \geqq Ta-Tb \geqq 0.07$ (N·m);
preferably, $0.15 \geqq Ta-Tb \geqq 0.1$ (N·m)

Figure 4:
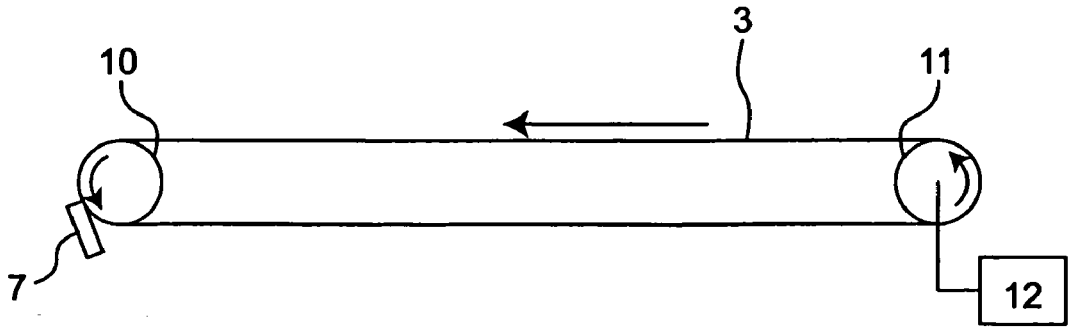
FIG. 4 is a schematic structural drawing that explains a measuring method for torque.

The dynamic torque Ta at the time when the cleaning blade is arranged in contact with the intermediate transfer member can be measured by the following method. In the image-forming apparatus, as shown in FIG. 4, the cleaning blade 7 and the extension rollers (10, 11) are used in their positions as they are, and except for those members, the members that are made in contact with the intermediate transfer member 3, for example, the latent-image supporting members (2*a*, 2*b*, 2*c* and 2*d*), the primary-transfer rollers (4*a*, 4*b*, 4*c* and 4*d*) and the secondary-transfer roller 5 are removed. Next, a torque meter 12 is attached to the shaft of the extension roller 11, and in an environment of 10° C. and 15% RH, the intermediate transfer member 3 is driven, so that the dynamic torque Ta is measured. In FIG. 4, the intermediate transfer member 3 is extended by the two extension rollers (10, 11), and the extension roller 11 of these is allowed to function as a driving roller; here, it is only necessary for the torque meter to be attached to the driving roller, and, for example, in the case when the extension roller 10 is allowed to function as the driving roller, the torque meter is attached to the extension roller 10. The intermediate transfer member 3 may be extended by three or more extension rollers to be passed over them. In this case also, the torque meter is attached to the driving roller among those rollers in the same manner as described above.

Upon these measuring processes, for example, the diameter of the driving roller is set to ϕ22.18 mm, that of the extension roller is set to ϕ24 mm, and the width of the intermediate transfer member is set to 357 mm.

The moving speed of the surface of the intermediate transfer member during measurements corresponds to a speed actually driven upon image-forming in the image-forming apparatus, and not particularly limited, the value preset in each of the image-forming apparatuses may be used.

The dynamic torque Tb at the time when the cleaning blade is placed apart from the intermediate transfer member can be measured by the same method as the above-mentioned measuring method for Ta, except that the measurements are carried out with the cleaning blade 7 being completely separated from the intermediate transfer member 3.

In the case when the intermediate transfer member is an intermediate transfer drum, Ta and Tb are respectively obtained by using the same measuring methods as the above-mentioned measuring methods of Ta and Tb, except that dynamic torques of the drum itself are measured.

The load torque by the cleaning blade, represented by a difference (Ta−Tb) of these Ta and Tb, means a frictional force exerted between the cleaning blade and the intermediate transfer member. By setting "Ta−Tb" in the above-mentioned range, the edge damage in the cleaning blade and insufficient cleaning of the intermediate transfer member can be prevented more effectively in a low temperature environment.

Ta and Tb are not particularly limited as long as the object of the present invention is achieved; normally, Ta is set in the range from 0.12 to 0.25 N·m, in particular, from 0.15 to 0.2 N·m, and Tb is set to 0.18 N·m or less, in particular, to 0.13 N·m or less. Ta can be controlled by adjusting the contact angle and the linear pressure (contact pressure) of the cleaning blade 7 to the intermediate transfer member. The contact angle is preferably adjusted in the range from 8 to 15°, and the linear pressure is preferably adjusted in the range from 25 to 40 N/m. Tb is a value determined by the supporting structure and the driving structure of the intermediate transfer member.

Figure 5:
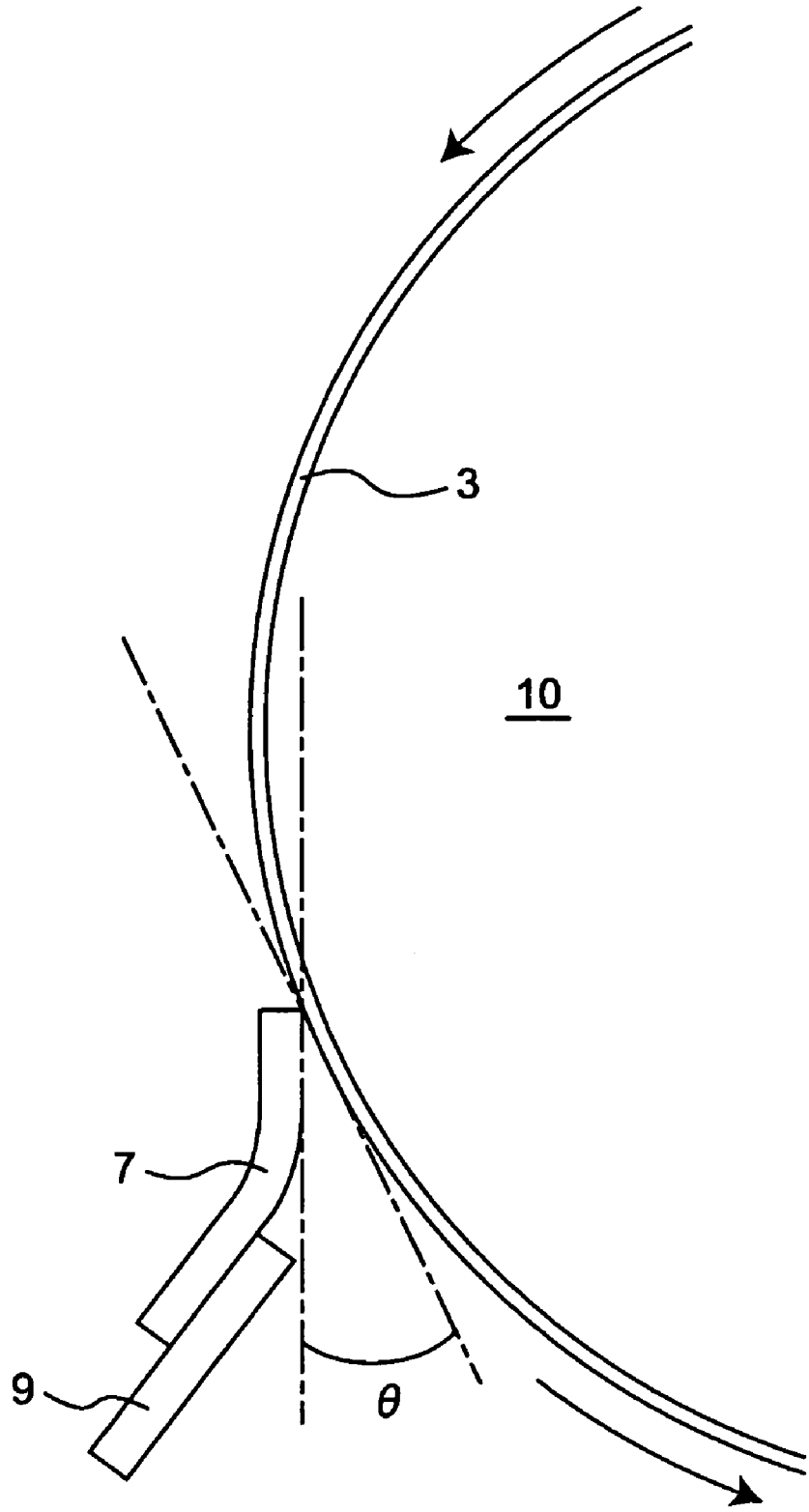
FIG. 5 is an enlarged schematic drawing that shows a neighboring section of a cleaning blade in one example of an embodiment of the present invention.

The contact angle, which is a so-called effective contact angle, represents an actual angle made by the tip of the cleaning blade 7 and the surface of the intermediate transfer member 3. In particular, as shown in FIG. 5, when the tip of the cleaning blade 7 is made in contact with the intermediate transfer belt 3 that is passed over the circumference of the extension roller 10 and the like, an angle θ is made by the tip of the cleaning blade 7 and the tangent of the intermediate transfer belt area that is made in contact with the tip. FIG. 5 is a schematic enlarged view showing the neighboring portion of the cleaning blade in FIG. 1, which is a cross-sectional view perpendicular to the axial direction of the roller 10. The effective contact angle can be found by calculating a deflection by using the cross-sectional shape of the cleaning blade and physical values such as Young's modulus; however, since a material such as rubber has a deformed shape at the contact portion by a pressure, the calculated value tends to deviate greatly from the actual value. For this reason, in the present invention, an actually measured angle, obtained when the cleaning blade in the contact state is laterally observed, is used as an effective contact angle.

Figure 6:
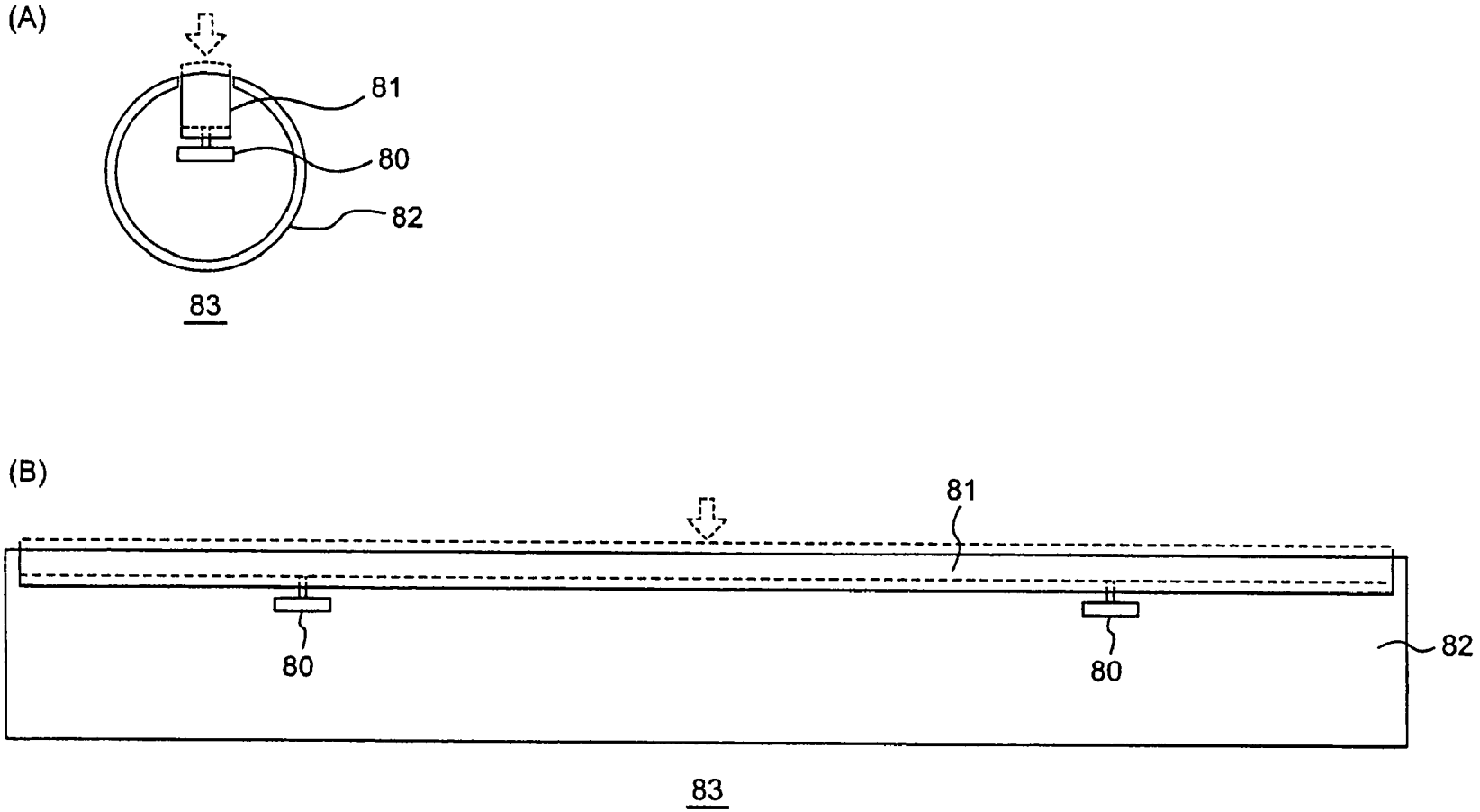
FIG. 6(A) is a schematic cross-sectional view that shows a jig used for measuring a linear pressure.
FIG. 6(B) is a schematic sketch drawing of the jig.

With respect to the linear pressure, a value measured by a jig using a load cell is used. More specifically, the linear pressure is measured by using a load converter which converts a load into a voltage value. A strain gauge type load converter 9E01-L43-10N (made by NEC Sanei Co., Ltd.) is listed as one example of the load converter. More specifically, as shown in FIG. 6(A), a load converter 80 and a pressing unit 81 are assembled into a cylinder-shaped member 82 as a measuring jig 83, so that a dummy cleaning opposed member for use in measuring is manufactured. At this time, the peripheral curved face of the pressing unit 81 has the same curvature radius as that of the peripheral surface of the transfer belt to be measured. FIG. 6(A) is a cross-sectional view perpendicular to the axis of the cylindrical member with respect to the measuring jig 83, and FIG. 6(B) is a schematic sketch drawing that shows the measuring jig of FIG. 6(A) viewed from a lateral direction. The blade is made in press-contact with the measuring jig 83 by using an attaching member that allows predetermined settings thereof, so that a load at the contact portion is measured. Based upon the load at the contact portion and the distance between the cleaning blade and the pressing portion of the measuring jig in the axis direction of the cylindrical member at the contact portion, the linear pressure is calculated based upon the following equation.

Liner load=Load at contact portion/Distance in axis direction of cylindrical member at contact portion An actual measured value is used for the linear pressure for the same reason as that of the contact angle.

In the case when an intermediate transfer belt is used as an intermediate transfer member 3, as shown in FIG. 5, the cleaning blade 7 is normally placed in contact with the intermediate transfer member at a portion where the intermediate transfer member is passed over the extension roller. The cleaning blade 7 is normally placed in a counter direction so as to face the moving direction of the surface of the intermediate transfer member 3, as shown in FIG. 5.

The cleaning blade 7 may be made from any material as long as it exerts the above-mentioned impact resilience, and examples of the material include urethane rubber, silicon rubber, fluororubber, chloroprene rubber and butadiene rubber. From the viewpoint of easily achieving the above-mentioned impact resilience, the cleaning blade 7 is preferably made from urethane rubber.

Such urethane rubber is available as a commercial product.

With respect to the shape of the cleaning blade 7, not particularly limited, a known blade shape conventionally adopted in the field of the cleaning device for the intermediate transfer member may be used. For example, a board shape is listed, and in use, as shown in FIG. 5, this is made in contact with the intermediate transfer member 3 by the holding member 9.

As shown in FIG. 1, the primary-transfer rollers 4 (4*a*, 4*b*, 4*c* and 4*d*) are placed on the side reversed to the latent-image supporting members 2 (2*a*, 2*b*, 2*c* and 2*d*) with respect the intermediate transfer member 3. Each of the primary-transfer rollers 4 is normally placed on the downstream side in the moving direction 21 of the intermediate transfer member from the contact portion between the latent-image supporting member 2 and the intermediate transfer member 3, so that by pressing the intermediate transfer member 3, it ensures a predetermined transferring pressure F.

With respect to the primary-transfer roller, such a member as prepared by forming EPDM, NBR or the like with carbon or the like dispersed therein as a conductive material on the surface of a core metal member, or a metal roller, may be used.

With respect to the secondary-transfer roller, such a member, prepared by forming EPDM, NBR or the like with carbon or the like dispersed therein as a conductive material on the surface of a core metal member, may be used.

Not particularly limited, the extension rollers (10, 11) may be made of, for example, metal rollers of aluminum, iron or the like. Such a roller, formed by placing a coating layer on the peripheral face of a core metal member, with the coating roller being prepared by dispersing conductive powder and carbon into an elastic member such as EPDM, NBR, urethane rubber and silicone rubber so that the resistivity thereof is adjusted to $1\times10^9\Omega\cdot$cm or less, may be used. In FIG. 1, the intermediate transfer member 3 is extended by the two extension rollers (10, 11) so as to be passed over them, and the extension roller 11 of these is allowed to function as a driving roller; however, the extension roller 10 may be used as a driving roller, or the intermediate transfer member 3 may be extended by three or more extension rollers so as to be passed over them, with any one of the extension rollers being used as a driving roller.

With respect to the other members and devices installed in the image-forming apparatus of the present invention, that is, for example, a charging device, a developing device and a cleaning device for the latent-image supporting member, not particularly limited, those known members and devices conventionally used in the image-forming apparatus may be used.

For example, with respect to the developing device, those having a mono-component developing system using only toner, or those having a two-component developing system using toner and carrier, may be used.

The toner may contain toner particles manufactured by a wet method such as a polymerization method or toner particles manufactured by a pulverizing method (dry method).

Not particularly limited, the average particle size of the toner is set to 7 μm or less, preferably in the range from 4.5 μm to 6.5 μm. The average roundness of the toner is preferably set in the range from 0.965 to 0.99, in particular from 0.965 to 0.98. The smaller the toner average particle size and the higher the average roundness, the higher the possibility of insufficient cleaning becomes; however, the present invention makes it possible to effectively prevent the above-mentioned problem of insufficient cleaning even when such a particle size and an average roundness are used.

The average particle size of the toner, which corresponds to a volume average particle size, is indicated by a value measured by an E-spurt analyzer (made by Hosokawamicron Corporation).

The average roundness of the toner is indicated by a value measured by FPIA-1000 (made by To a Iyou Denshi Co., Ltd.).

EXAMPLES

Experimental Example 1

Production of Transfer Belt A

A base member having a seamless shape, which was made from a PPS resin having carbon dispersed therein and had a surface resistivity of $1.30\times10^9\Omega/\square$, with a thickness of 0.15 mm, was obtained by using an extrusion-molding process.

A $SiO_2$ thin-film layer (hardness: 4 GPa) having a film thickness of 300 nm was formed on the outer circumferential surface of the base member by an atmospheric pressure plasma CVD method, so that a transfer belt A was obtained.

(Production of Cleaning Blade A)

Urethane rubber having an impact resilience of 18% at 20° C., a JIS A hardness of 72 degrees and a Young's modulus of 7.4 MPa was cut into a dimension of 2 mm×13 mm×330 mm, and used as a cleaning blade A for a transfer belt.

(Production of Cleaning Blade B)

By carrying out the same method as the manufacturing method of the cleaning blade A except that urethane rubber having an impact resilience of 20% at 20° C., a JIS A hardness of 77 degrees and a Young's modulus of 9.8 MPa was used, a cleaning blade B was obtained.

(Production of Cleaning Blade C)

By carrying out the same method as the manufacturing method of the cleaning blade A except that urethane rubber having an impact resilience of 28% at 20° C., a JIS A hardness of 71 degrees and a Young's modulus of 6.8 MPa was used, a cleaning blade C was obtained.

(Production of Cleaning Blade D)

By carrying out the same method as the manufacturing method of the cleaning blade A except that urethane rubber having an impact resilience of 40% at 20° C., a JIS A hardness of 77 degrees and a Young's modulus of 8.5 MPa was used, a cleaning blade D was obtained.

(Production of Cleaning Blade E)

By carrying out the same method as the manufacturing method of the cleaning blade A except that urethane rubber having an impact resilience of 50% at 20° C., a JIS A hardness of 70 degrees and a Young's modulus of 6.9 MPa was used, a cleaning blade E was obtained.

(Production of Cleaning Blade F)

By carrying out the same method as the manufacturing method of the cleaning blade A except that urethane rubber having an impact resilience of 57% at 20° C., a JIS A hardness of 70 degrees and a Young's modulus of 6.6 MPa was used, a cleaning blade F was obtained.

(Evaluation)

Cleaning Characteristic

The transfer belt A and each of the cleaning blades were assembled in a color MFP Bizhub C352 (made by Konica Minolta Technologies, Inc.) having a structure shown in FIG. 1, and after 5000 prints had been produced in a high temperature-high humidity (HH) environment (30° C., 85% RH), 5000 prints of an image of a print rate of 50% were continuously produced in a low temperature-low humidity (LL) environment (10° C., 15% RH), and the resulting images were evaluated on insufficient cleaning. A polymerized toner having an average particle size of 4.5 μm and an average roundness of 0.980 was used as the toner. The dynamic torque Tb was 0.05 N·m.

○: No stripe scumming was generated on an image due to insufficient cleaning; and x: Stripe scumming was clearly generated on an image due to insufficient cleaning.

Edge Damage

Upon evaluating the cleaning characteristic, the contact edge of the cleaning blade to the intermediate transfer member was observed under an optical microscope.

○: No damage such as breakage and chipping was observed.

x: Damage such as breakage and chipping was observed.

The results of evaluation were shown in the following Table together with the measured torque values.

TABLE 1

| HH (5000 prints)-LL (5000 prints) | | | | |
|---|---|---|---|---|
| Kinds of blades | Impact resilience (%) | Ta - Tb (N/m) | Cleaning characteristic | Edge damage |
| Blade A | 18 | 0.07 | X | ○ |
| Blade B | 20 | 0.07 | ○ | ○ |
| Blade C | 28 | 0.07 | ○ | ○ |
| Blade D | 40 | 0.07 | ○ | ○ |
| Blade E | 50 | 0.07 | ○ | ○ |
| Blade F | 57 | 0.07 | ○ | X |

TABLE 2

| Kinds of blades | Ta - Tb (N/m) | Cleaning characteristic | Edge damage |
|---|---|---|---|
| Blade A | 0.07 | X | ○ |
| (Impact resilience 18%) | 0.11 | X | ○ |
| | 0.14 | X | ○ |
| | 0.20 | X | ○ |
| Blade B | 0.07 | ○ | ○ |
| (Impact resilience 20%) | 0.11 | ○ | ○ |
| | 0.14 | ○ | ○ |
| | 0.20 | ○ | ○ |
| Blade C | 0.07 | ○ | ○ |
| (Impact resilience 28%) | 0.11 | ○ | ○ |
| | 0.14 | ○ | ○ |
| | 0.20 | ○ | ○ |
| Blade D | 0.07 | ○ | ○ |
| (Impact resilience 40%) | 0.11 | ○ | ○ |
| | 0.14 | ○ | ○ |
| | 0.20 | ○ | ○ |
| Blade E | 0.07 | ○ | ○ |
| (Impact resilience 50%) | 0.11 | ○ | ○ |
| | 0.14 | ○ | ○ |
| | 0.20 | ○ | ○ |
| Blade F | 0.07 | ○ | X |
| (Impact resilience 57%) | 0.11 | ○ | X |
| | 0.14 | ○ | X |
| | 0.20 | ○ | X |

In Example 1, the toner having an average particle size of 4.5 μm and an average roundness of 9.8 was used, and the same experiment as Example 1 was further carried out by using a toner having an average particle size of 6.5 μm and an average roundness of 9.8. As a result, in the same manner as in Example 1, when a cleaning blade having an impact resilience of 20 to 50% was used, it was confirmed that superior cleaning characteristic and edge damage resistance were obtained.

The same experiment as Experimental Example 1 was carried out by using a transfer belt B on which a $SiO_2$ thin film (hardness 7 GPa) having a film thickness of 300 nm was formed as a hard releasing layer by altering the amount of material gas supply in an atmospheric pressure plasma CVD, in place of the transfer belt A. In this case also, in the same manner as in Experimental Example 1, when a cleaning blade having an impact resilience of 20 to 50% was used, it was confirmed that superior cleaning characteristic and edge damage resistance were obtained.

Experimental Example 2

By using the same method as Experimental Example 1 except that the cleaning blades A and C were used with the contact angle and the linear pressure of the cleaning blade to the intermediate transfer member being set to predetermined values, and that the printing process was carried out in the following method, evaluation was made on the cleaning characteristic.

After the cleaning blade had been assembled therein, 10000 prints of an image of a print rate of 50% were continuously produced in a low temperature-low humidity (LL) environment (10° C., 15% RH).

TABLE 3

| LL (10000 prints) | | | |
|---|---|---|---|
| Kinds of blades | Contact angle (°) | Linear pressure (N/m) | Cleaning characteristic |
| Blade A | 8 | 25 | X |
| (Impact resilience 18%) | 10 | 29 | X |
| | 12.7 | 29 | X |
| | 15 | 40 | X |
| Blade C | 8 | 25 | ○ |
| (Impact resilience 28%) | 10 | 29 | ○ |
| | 12.7 | 29 | ○ |
| | 15 | 40 | ○ |

Experimental Example 3

By using the same method as Experimental Example 1 except that the cleaning blade C was used, that a transfer belt A after having been used for continuous printing processes of 150000 sheets was used, that Ta−Tb was controlled to a predetermined value by adjusting the contact angle and the linear pressure of the cleaning blade to the intermediate transfer member, and that the printing process was carried out in the following method, evaluation was made on the cleaning characteristic.

The cleaning blade was assembled in a color MFP Bizhub C352 (made by Konica Minolta Technologies, Inc.) together with the transfer belt, and this was left in a low temperature-low humidity (LL) environment (10° C., 15% RH) for 90 hours. Thereafter, a solid image made from two layers of cyan and magenta was formed on the transfer belt, and without carrying out a secondary transferring process, this was subjected to a cleaning process, and evaluation was made on the cleaning characteristic at this time.

○: No insufficient cleaning was observed on the transfer belt; and x: Insufficient cleaning was clearly observed on the transfer belt.

TABLE 4

| Ta - Tb (N/m) | Cleaning characteristic |
|---|---|
| 0.01 | X |
| 0.03 | X |
| 0.06 | X |
| 0.07 | ○ |
| 0.11 | ○ |
| 0.14 | ○ |

TABLE 4-continued

| Ta - Tb (N/m) | Cleaning characteristic |
|---|---|
| 0.17 | ○ |
| 0.20 | ○ |

What is claimed is:

1. An image-forming apparatus comprising:

an intermediate transfer member that has a hard releasing layer formed on a surface thereof, supports a toner image primary-transferred on the hard releasing layer from a latent-image supporting member, and secondary-transfers the supported toner image onto an image-receiving medium, and a cleaning blade that is arranged in contact with the intermediate transfer member, and removes residual toner from the hard releasing layer of the intermediate transfer member, wherein the cleaning blade has an impact resilience in the range from 20 to 50% at 20° C.;

wherein a dynamic torque Ta upon driving the intermediate transfer member measured at a time when the cleaning blade is arranged in contact with the intermediate transfer member and a dynamic torque Tb upon driving the intermediate transfer member measured at a time when the cleaning blade is placed apart from the intermediate transfer member satisfy the following relationship: 0.07 (Nm)≦Ta−Tb≦0.2(Nm); and wherein the hard releasing layer is an inorganic oxide layer containing silicon oxide.

2. The image-forming apparatus of claim 1, wherein the hard releasing layer has a hardness of 2 GPa or more based upon a nano indentation method.

3. The image-forming apparatus of claim 1, wherein the hard releasing layer is formed as a hard carbon-containing layer.

4. The image-forming apparatus of claim 1, wherein the intermediate transfer member has a seamless belt shape and is extended by two or more extension rollers so as to be driven by any one of the extension rollers.

5. The image-forming apparatus of claim 1, wherein the cleaning blade has an impact resilience in the range from 25 to 40% at 20° C.

6. The image-forming apparatus of claim 1, wherein Ta is set in the range from 0.12 to 0.25 Nm.

7. The image-forming apparatus of claim 2, wherein the hard releasing layer has a hardness in the range from 2 to 11 GPa.

* * * * *